US009037016B2

(12) United States Patent
Tanaka

(10) Patent No.: US 9,037,016 B2
(45) Date of Patent: May 19, 2015

(54) APPARATUS FOR FORMING IMAGE ACCORDING TO IMAGE FORMATION CONDITION

(75) Inventor: Sumito Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 21 days.

(21) Appl. No.: 13/600,536

(22) Filed: Aug. 31, 2012

(65) Prior Publication Data

US 2013/0064561 A1 Mar. 14, 2013

(30) Foreign Application Priority Data

Sep. 14, 2011 (JP) ..... 2011-200972

(51) Int. Cl.
*G03G 15/00* (2006.01)

(52) U.S. Cl.
CPC .. *G03G 15/5062* (2013.01); *G03G 2215/00067* (2013.01)

(58) Field of Classification Search
USPC ..... 399/49, 72
See application file for complete search history.

(56) References Cited

U.S. PATENT DOCUMENTS

| | | | | |
|---|---|---|---|---|
| 5,694,637 | A * | 12/1997 | Yoshino et al. | 399/38 |
| 5,697,012 | A * | 12/1997 | Sasanuma et al. | 399/49 |
| 7,385,737 | B2 | 6/2008 | Zaima | |
| 7,937,008 | B2 * | 5/2011 | Fujishima et al. | 399/49 |
| 8,797,615 | B2 | 8/2014 | Itagaki | |
| 2003/0038983 | A1 | 2/2003 | Tanabe et al. | |
| 2010/0309525 | A1 | 12/2010 | Tanaka | |

FOREIGN PATENT DOCUMENTS

| | | | |
|---|---|---|---|
| CN | 1431562 | A | 7/2003 |
| CN | 102137760 | A | 7/2011 |
| JP | 08-156330 | A | 6/1996 |
| JP | 2002-55573 | A | 2/2002 |
| JP | 2002-072574 | A | 3/2002 |
| JP | 2003-215981 | A | 7/2003 |
| JP | 2004-185029 | A | 7/2004 |
| JP | 2009-014997 | A | 1/2009 |

OTHER PUBLICATIONS

Search Report issued in European Patent Application No. 12183942.7, dated Apr. 7, 2014.
Notification of the First Office Action—Chinese Patent Appln. No. 2012103420462, State Intellectual Property Office of the People's Republic of China, Oct. 10, 2014.

* cited by examiner

*Primary Examiner* — Hoang Ngo
(74) *Attorney, Agent, or Firm* — Fitzpatrick, Cella, Harper & Scinto

(57) ABSTRACT

An image forming apparatus adjusts a gamma-LUT of a gamma correction circuit in accordance with density data on a measurement image formed on a photosensitive drum. A CPU selects a conversion table in association with the image formation condition such as laser power of a semiconductor laser, fixing temperature of a fixing device, or a charge in a developer. A luminance/density converting portion converts luminance data on the measurement image into density data using the conversion table selected by the CPU. The CPU adjusts a contrast potential and a gamma-LUT using this density data.

7 Claims, 12 Drawing Sheets

FIG. 5A

| CONVERSION TABLE | LASER POWER VALUE |
|---|---|
| CONVERSION TABLE 42a | 255~200 |
| CONVERSION TABLE 42b | 200~144 |
| CONVERSION TABLE 42c | 143~90 |
| CONVERSION TABLE 42d | 90~0 |

FIG. 5B

| CONVERSION TABLE | LASER POWER VALUE |
|---|---|
| CONVERSION TABLE 42a1 | 255~200 |
| CONVERSION TABLE 42a2 | 200~144 |
| CONVERSION TABLE 42a3 | 143~90 |
| CONVERSION TABLE 42a4 | 90~0 |

SPECTRAL CHARACTERISTIC OF YELLOW TONER

SPECTRAL CHARACTERISTIC OF MAGENTA TONER

SPECTRAL CHARACTERISTIC OF CYAN TONER

SPECTRAL CHARACTERISTIC OF BLACK TONER

APPARATUS FOR FORMING IMAGE ACCORDING TO IMAGE FORMATION CONDITION

BACKGROUND OF THE INVENTION

1. Field of the Invention

The present invention relates to an image forming apparatus such as a copy machine or a laser beam printer, for example.

2. Description of the Related Art

Image formation conditions (for example, a gamma correction table, laser power, fixing temperature, electric charge of toner) used in an image forming apparatus to form a high-quality image need to be changed as appropriate depending on an installation environment (for example, temperature and humidity) of the image forming apparatus, or operating time thereof.

Japanese Patent Laid-Open No. 2002-072574 proposes a technique for performing color adjustment by forming a measurement image such as a patch or a pattern image on a transfer member, detecting the amount of applied toner of the measurement image using a regular reflection sensor, and feeding back the detected amount applied toner to a lookup table. Thus color stability is maintained without bothering a user.

Meanwhile, Japanese Patent Laid-Open No. 2003-215981 proposes a technique for controlling the amount of used recording material at an optimum value by operating outputs of an irregular reflection sensor and a regular reflection sensor.

Meanwhile, the abovementioned conventional techniques still have the following problem, and there is a room for improvement.

Generally, a measurement image detecting portion detects light reflected by the measurement image, and outputs a signal corresponding to a received reflected light amount (reflection output) to a density conversion circuit. Because the reflection output is a kind of luminance signal, the density conversion circuit converts the reflection output into a density signal. Usually, a relationship exists where as an attached toner amount becomes larger and an image density becomes higher, a reflection output becomes smaller. The density conversion circuit converts the reflection output having such a characteristic into an image density at the time of being formed on a recording material.

Incidentally, the image formation conditions are adjusted in every use of an image forming apparatus, and therefore change from time to time. For example, a target density and a target potential are maintained at appropriate values by density adjustment, potential control, or the like. However, it has been found that when the image formation conditions change, a correspondence between the reflection output and the image density held by the density conversion circuit becomes different from the actual relationship. If the correspondence between the reflection output and the image density becomes different from its initial state, accurate density control or potential control cannot be performed. If the conversion between the reflection output and the image density cannot be performed, a high-quality image will not be able to be formed.

SUMMARY OF THE INVENTION

Therefore, the present invention provides an image forming apparatus that forms a high-quality image even if an image formation condition changes by switching, upon the change in the image formation condition, a conversion table for converting a luminance of a measurement image into a density to one associated with that image formation condition.

The present invention in its first aspect provides an image forming apparatus comprising the following elements. A detection unit is configured to detect a measurement image formed on an image carrier and output luminance data on the measurement image. A storage unit is configured to store a plurality of conversion tables for converting the luminance data output by the detection unit into density data, the conversion tables being prepared in advance in association with different image formation conditions. A selection unit is configured to select a conversion table associated with an image formation condition used by the image forming apparatus from among the plurality of conversion tables stored in the storage unit. A tone correction unit is configured to convert the luminance data on the measurement image output by the detection unit into density data using the conversion table selected by the selection unit, and perform tone correction in accordance with the converted density data.

The present invention in its second aspect provides an image forming apparatus comprising the following elements. An adjustment unit is configured to adjust an image formation condition in accordance with a physical parameter measured without using a measurement image. A detection unit is configured to detect a measurement image formed on an image carrier and output luminance data on the measurement image. A storage unit is configured to store a plurality of conversion tables for converting the luminance data output by the detection unit into density data, the conversion tables being prepared in advance in association with different image formation conditions. A selection unit is configured to select, every time the image formation condition is adjusted by the adjustment unit, a conversion table associated with the adjusted image formation condition from among the plurality of conversion tables stored in the storage unit. A tone correction unit is configured to convert the luminance data on the measurement image output by the detection unit into density data using the conversion table selected by the selection unit, and perform tone correction in accordance with the converted density data.

The present invention in its third aspect provides an image forming apparatus comprising the following elements. A detection means detects a measurement image formed on an image carrier and output luminance data on the measurement image. A storage means stores a plurality of conversion tables for converting the luminance data output by the detection means into density data, the conversion tables being prepared in advance in association with different image formation conditions. A selection means selects a conversion table associated with an image formation condition used by the image forming apparatus from among the plurality of conversion tables stored in the storage means. A tone correction means converts the luminance data on the measurement image output by the detection means into density data using the conversion table selected by the selection means, and performs tone correction in accordance with the converted density data.

Further features of the present invention will become apparent from the following description of exemplary embodiments (with reference to the attached drawings).

BRIEF DESCRIPTION OF THE DRAWINGS

FIGS. 5A and 5B are diagrams showing examples of correspondence tables each for holding a correspondence between image formation conditions and conversion tables;

DESCRIPTION OF THE EMBODIMENTS

As an example of an image forming apparatus according to the present embodiment, a digital monochrome copy machine will be used in the following description. The feature of the present embodiment lies in that a density conversion table is changed in accordance with laser power of a light source among several types of image forming conditions. Note that it is well known that a measurement image such as a patch or a pattern image is formed on an image carrier or a recording material and an LUT for a gamma correction circuit is corrected based on density of the measurement image, and therefore, the description thereof will be omitted. The "LUT" is an abbreviation of a look-up table. The recording material is also called recording medium, sheet, or sheet material in some cases.

Figure 1:
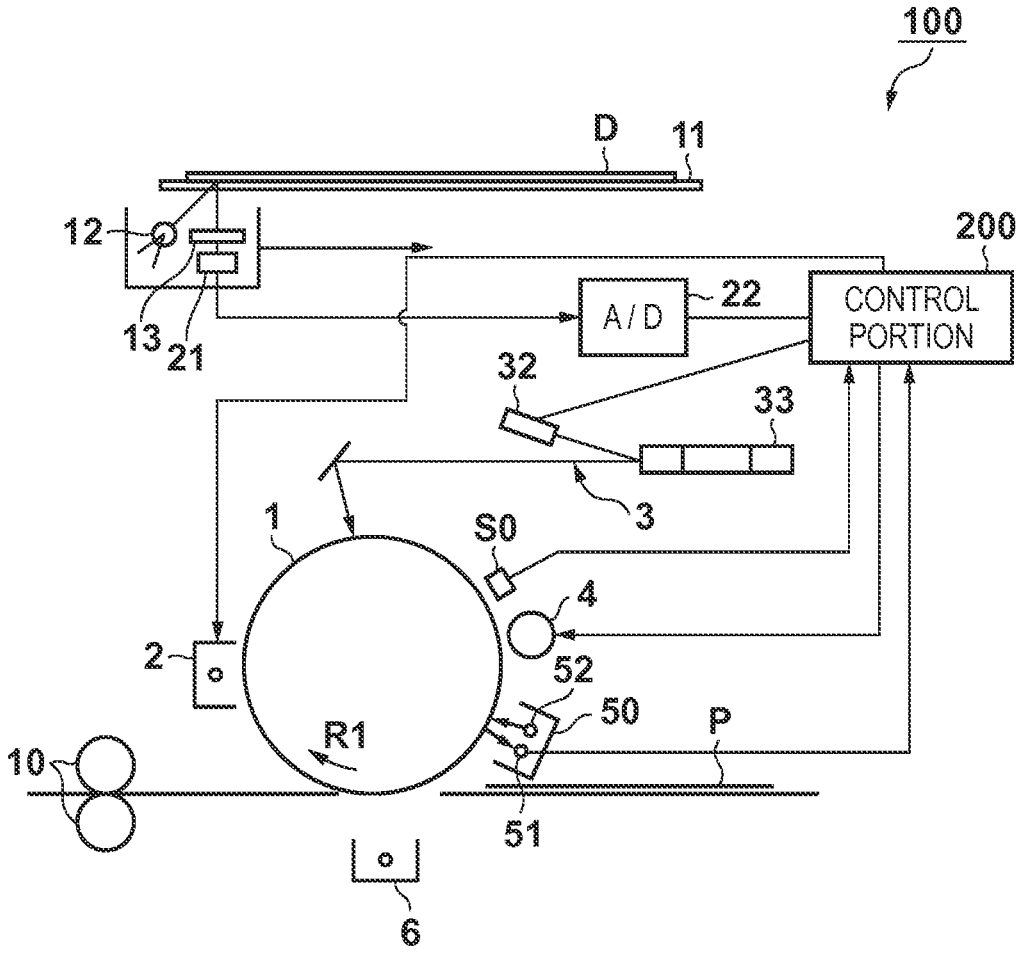
FIG. 1 is a vertical cross-sectional view showing a schematic configuration of an image forming apparatus according to the first embodiment.

In FIG. 1, an image forming apparatus 100 performs tone correction in accordance with density data on a measurement image formed on an image carrier. A control portion 200 is a control unit for comprehensively controlling the overall image forming apparatus 100. The control portion 200 executes tone correction using the measurement image, and adjusts an image formation condition in accordance with physical parameters measured without using the measurement image.

For example, the control portion 200 adjusts an image formation condition such as a developing bias potential Vdc applied to a developing device 4, a driving current for a semiconductor laser 32, a grid potential Vg applied to a primary charging device 2, or the like.

A light source 12 irradiates a document D with illumination light. An optical system 13 forms a document image on a CCD 21. The "CCD" is an abbreviation of a charge-coupled device. The light source 12, the optical system 13, and the CCD 21 are provided on a reader unit. The document D is scanned by the reader unit moving along the arrow. A luminance signal of the document image is digitalized by an A/D conversion circuit 22 and output as image data to the control portion 200.

The control portion 200 performs image processing on the image data as necessary, and drives the semiconductor laser 32, which is a light source, based on the image data. The semiconductor laser 32 is a light source that is adjusted to have a prescribed reference light amount by auto light power control (APC). After the semiconductor laser 32 is continuously used, its laser power gradually lowers even if a current at a constant level is kept flowing therethrough. Therefore, while laser light 3 is scanned over a non-image forming zone, the driving current is adjusted by APC so as to obtain a constant reference light amount. In the case where local sensitivity reduction is occurring on the surface of a photosensitive drum 1, the laser power is possibly increased when that portion is irradiated with the laser light 3. Generally, an area of a beam spot per dot is changed by performing pulse width modulation on the driving current for the semiconductor laser 32. When the beam spot area is changed, an amount of applied toner is also changed, and as a result, an image tone is expressed. Note that the non-image forming zone is provided with an optical sensor for receiving the laser light 3 and outputting a signal indicating a light-receiving level (light amount). The level of reception of the laser light 3 is an example of the physical parameters measured without using a measurement image.

The control portion 200 controls the primary charging device 2 to uniformly charge the surface of the photosensitive drum 1. The laser light 3 emitted by the semiconductor laser 32 is deflected by a polygon mirror 33, and the photosensitive drum 1, which is an image carrier, is irradiated therewith. Thus, an electrostatic latent image corresponding to the input image data is formed on the photosensitive drum 1.

The developing device 4, whose developing bias potential Vdc is controlled by the control portion 200, develops the electrostatic latent image on the photosensitive drum 1 using a developer containing toner to form a toner image. The recording material P is transported in synchronization with an image leading edge of the toner image. A transfer charging device 6 is a transfer unit for transferring the toner image from the photosensitive drum 1 onto the recording material P. The fixing device 10 heats and presses the toner image transferred onto the recording material P to fix the toner image onto the recording material P.

On the upstream side of the developing device 4 in the rotation direction R1 of the photosensitive drum 1, a potential sensor S0 is provided. The potential sensor S0 measures surface potential of the photosensitive drum 1. As is known well, the control portion 200 controls the grid potential Vg of the primary charging device 2 and the developing bias potential Vdc of the developing device 4.

Further, on the downstream side of the developing device 4 in the rotation direction R1 of the photosensitive drum 1, a detecting portion 50 having a LED 52 and a photosensor 51 is arranged. The detecting portion 50 functions a detection unit for detecting the measurement image formed on the photosensitive drum 1 and outputting luminance data on this measurement image. The LED 52 functions as a light-emitting unit for emitting light towards the measurement image on the photosensitive drum 1. The photosensor 51 functions as a light-receiving unit for receiving light reflected by the measurement image and outputting an analog luminance signal corresponding to the amount of the received reflected light.

Figure 2:
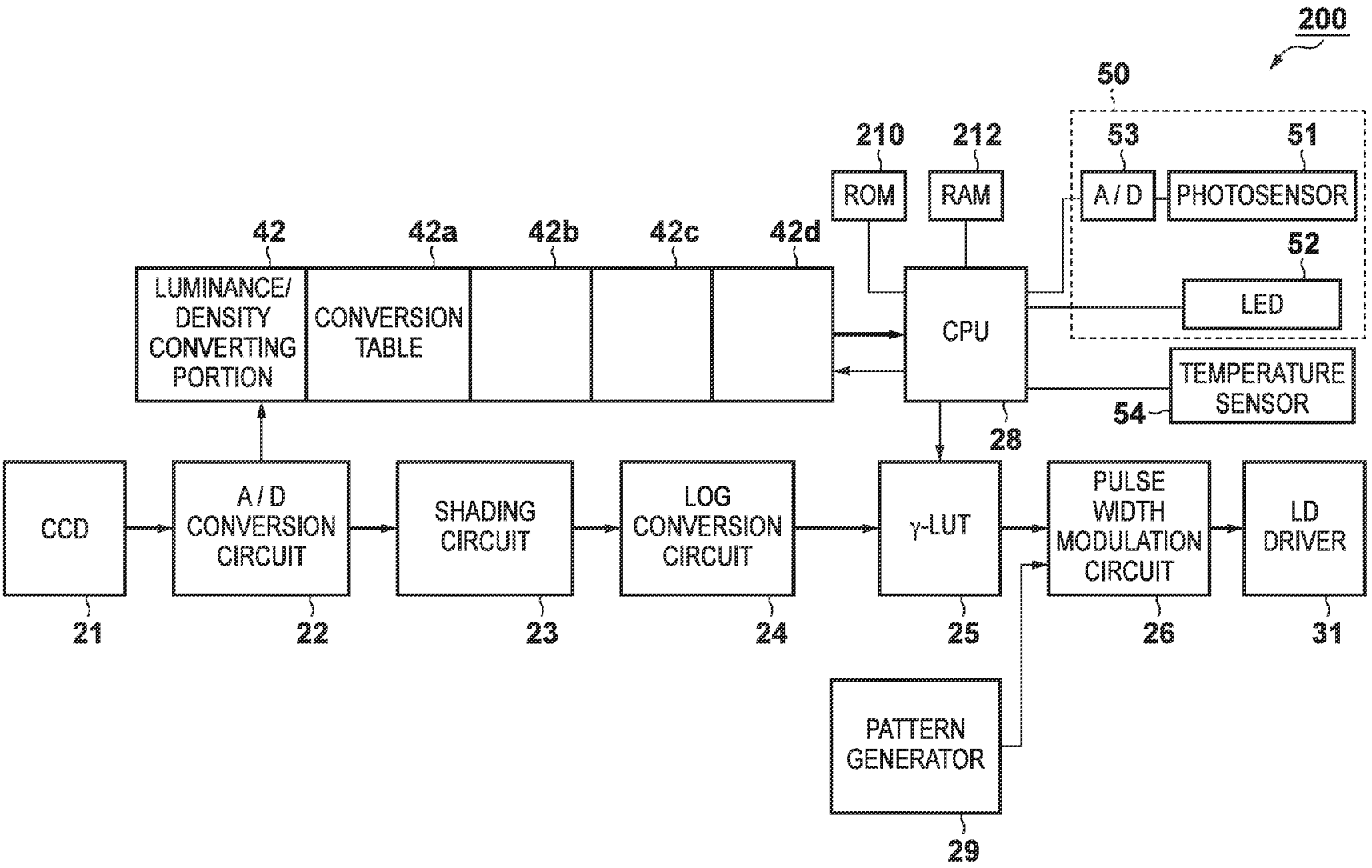
FIG. 2 is a block diagram showing an image signal flow in the image forming apparatus according to the first embodiment.

Next, the flow of an image signal from the CCD 21 to the laser light 3 according to the present embodiment will be described with reference to FIG. 2. A CPU 28, such as a microprocessor, executes various kinds of control in accordance with control programs stored in a ROM 210 or various data. The RAM 212 is a storage device used as a work area for the CPU 28. The CPU 28 is connected to the abovementioned LED 52 and photosensor 51. The photosensor 51 may have a built-in A/D converter 53 for converting the analog luminance signal into digital luminance data, or the A/D converter 53 may alternatively be provided outside the photosensor 51.

The CPU 28 is connected to a temperature sensor 54 for measuring a temperature of the fixing device 10. Note that a sensor for detecting an absolute water content in the atmosphere environment may be connected to the CPU 28. The absolute water content is used by the CPU 28 to determine an initial value of a contrast potential Vcont. Also, the absolute water content is an example of the physical parameters measured without using a measurement image.

A luminance signal corresponding to the document image obtained by the CCD 21 in a reader portion is digitalized by the A/D conversion circuit 22. A shading circuit 23 adjusts an amplification gain for each sensor cell in a sensor cell group in the CCD 21 to reduce influence of uneven sensitivity of individual sensor cells arrayed in a row. A LOG conversion circuit 24 converts an output signal from the shading circuit 23 from a luminance scale into a density scale. Thus the luminance signal is converted into a density signal.

A gamma-LUT 25 is a conversion table that can be rewritten by the CPU 28. The gamma-LUT 25 converts and outputs a tone of an input density signal. The CPU 28 adjusts the gamma-LUT 25, which serves as a gamma correction circuit, in accordance with density data on the measurement image formed on the photosensitive drum 1.

A pulse width modulation circuit 26 functions as a modulation unit for changing the driving current for driving the semiconductor laser 32 depending on image data, and thereby forming a latent image corresponding to the image data on the photosensitive drum 1. The pulse width modulation circuit 26 converts the density signal into a signal corresponding to light-emission duration time of the laser light 3, and delivers the signal to a laser driver 31. The light-emission duration time of the laser light 3 is associated with the density (tone) of an image to be formed. The semiconductor laser 32 repeats turning on and off in accordance with this signal.

Incidentally, a pattern generator 29 is mounted on the control portion 200. The pattern generator 29 holds a tone pattern (measurement image) shown in FIG. 3. The pattern generator 29 directly delivers a signal to the pulse width modulation circuit 26 in accordance with an instruction given by the CPU 28. In other words, when the measurement image is formed, the gamma-LUT 25 does not affect the image signal.

A luminance/density converting portion 42 has a plurality of conversion tables 42*a* to 42*d* for converting luminance data into density data. The conversion tables 42*a* to 42*d* are prepared in advance in association with mutually different image formation conditions. The CPU 28 selects, from among the conversion tables 42*a* to 42*d*, a conversion table associated with the image formation condition currently used in the image forming apparatus 100. The CPU 28, upon detecting the change in the image formation condition, selects a conversion table associated with the changed image formation condition. Exemplary types of image formation conditions include laser power (reference light amount) of the semiconductor laser 32, fixing temperature of the fixing device 10, and toner charge in the developer. Because adjustment of those image formation conditions is executed under the control of the CPU 28, the CPU 28 can detect the change in the image formation conditions.

The luminance/density converting portion 42 converts the luminance data on the measurement image detected by the detecting portion 50 into density data using the conversion table selected by the CPU 28.

Figure 4:
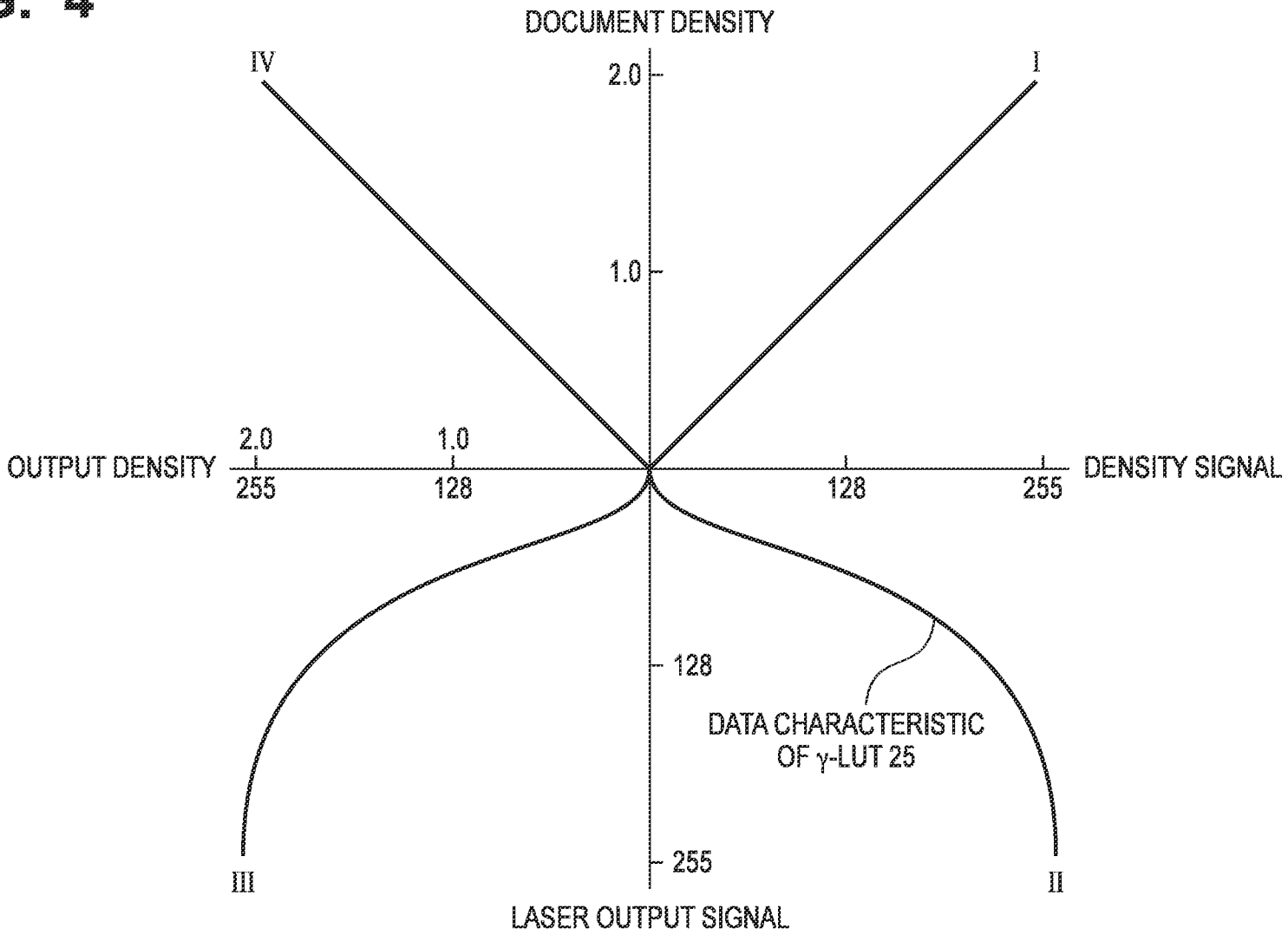
FIG. 4 is a four-quadrant chart showing characteristics with which density of a document image is reproduced.

Next, the role of the gamma-LUT 25 will be described. FIG. 4 is a four-quadrant chart showing characteristics with which density of a document image is reproduced. Quadrant I shows a characteristic of the reader portion in the image forming apparatus 100 that converts document density into a density signal. Quadrant II shows a characteristic of the gamma-LUT 25 that converts the density signal into a laser output signal. Quadrant III shows a characteristic of a printer portion in the image forming apparatus 100 that converts the laser output signal into output density (density of a toner image on the recording material P). Quadrant IV shows a relationship between the output density and the document density. Thus, those characteristics represent overall tone characteristics in the image forming apparatus 100. Note that in the case where processing is performed with an 8-bit digital signal, the number of tones is 256.

If the document image is copied to form a duplicate, it is expected that density of the document image agree with density of the duplicate. Therefore, the image forming apparatus 100 corrects a curved section in a recording characteristic of the printer portion shown in Quadrant III based on the gamma-LUT 25 shown in Quadrant II, thereby keeping a tone characteristic shown in Quadrant IV to be linear. The gamma-LUT 25 can be easily created by inverting an input-output relationship in the characteristic in Quadrant III. That is, a laser output signal at the time when a measurement image is formed needs only be replaced with a density signal obtained from the measurement image. Thus the gamma-LUT 25 converts the density signal of the document image into the laser output signal.

The detecting portion 50 detects light reflected by the measurement image and outputs a reflection output at the time when the measurement image comes to a position opposite the detecting portion 50. The reflection output is a kind of a luminance signal. The luminance/density converting portion 42 converts the reflection output for the measurement image into a density signal using the conversion table selected by the CPU 28. In the present embodiment, elements employed for the LED 52 and the photosensor 51 have a light emission peak and a light reception sensitivity peak of 960 nm, respectively.

As described above, the luminance/density converting portion 42 has the conversion tables 42*a* to 42*d*. The conversion tables 42*a* to 42*d* may be stored in the RAM 212, or in a memory built in the luminance/density converting portion 42. In either case, the CPU 28 creates the conversion tables 42*a* to 42*d* and stores them in that storage device. Then, the CPU 28 selects a conversion table associated with the latest image formation condition currently in use. The luminance/density converting portion 42 converts a luminance signal into a density signal using the conversion table selected by the CPU 28. Although four conversion tables 42*a* to 42*d* are used as an example here, the number of the conversion tables may be any number of 2 or larger. The method for creating the conversion tables 42*a* to 42*d* is already known, and the detail description thereof will be omitted.

As shown in FIG. 5A, the conversion tables 42*a* to 42*d* are prepared in advance in accordance with the light amount (laser power) of the light source, which is an example of the types of the image formation conditions. Note that the plurality of conversion tables may be substantially achieved by the CPU 28 performing prescribed calculation (coefficient multiplication or the like) in accordance with the laser power with respect to one conversion table used as a reference. According to FIG. 5A, the laser power is expressed by 8 bits.

The light reflected by the toner that enters the photosensor 51 is near infrared light. In FIG. 2, the photosensor 51 converts the reflected light into an electric signal. This electric signal is a kind of luminance signal that varies in the range of 0 V to 5 V. The A/D converter 53 converts this electric signal into a digital luminance signal of a level ranging from 0 to 255 in proportion to a voltage level of the electric signal. In other words, the A/D converter 53 functions as an AD conversion unit for converting the analog luminance signal output by the photosensor 51 and outputting digital luminance data. The digital luminance signal is delivered, via the CPU 28, to the luminance/density converting portion 42. The CPU 28 refers to the correspondence table shown in FIG. 5A, selects the conversion table associated with the laser power set currently for the semiconductor laser 32, and sets the selected conversion table for the luminance/density converting portion 42. The luminance/density converting portion 42 converts the digital luminance signal into a density signal using the conversion table selected by the CPU 28. The density signal is input to the CPU 28.

Figure 6A:
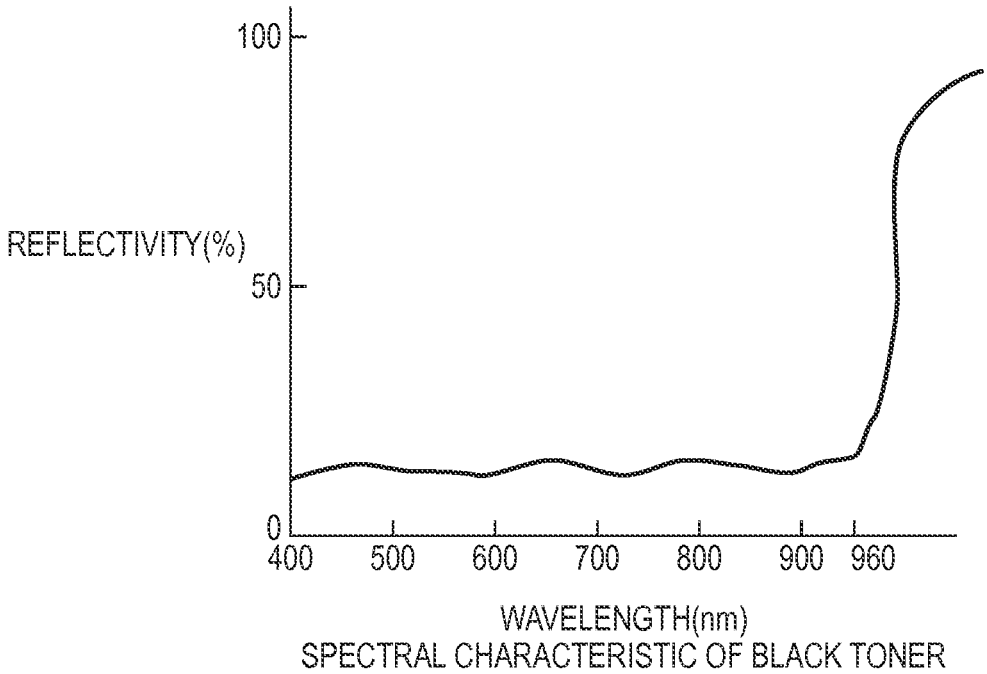
FIG. 6A is a diagram showing a spectral characteristic of black toner.

In the present embodiment, one-component magnetic toner is employed as a black developer. The one-component magnetic toner has a good performance in running cost reduction for monochrome copy. FIG. 6A shows a spectral characteristic of the black toner. As shown in FIG. 6A, the reflectivity of near infrared light (960 nm) from the black toner is about 10%. Note that two-component toner may alternatively be employed as the black developer. Also, the photosensitive drum 1 in the present embodiment is an OPC (organic photo conductor) drum, and its reflectivity with respect to near infrared light (960 nm) is about 40%. The photosensitive drum 1 may be an amorphous silicon drum.

Figure 6B:
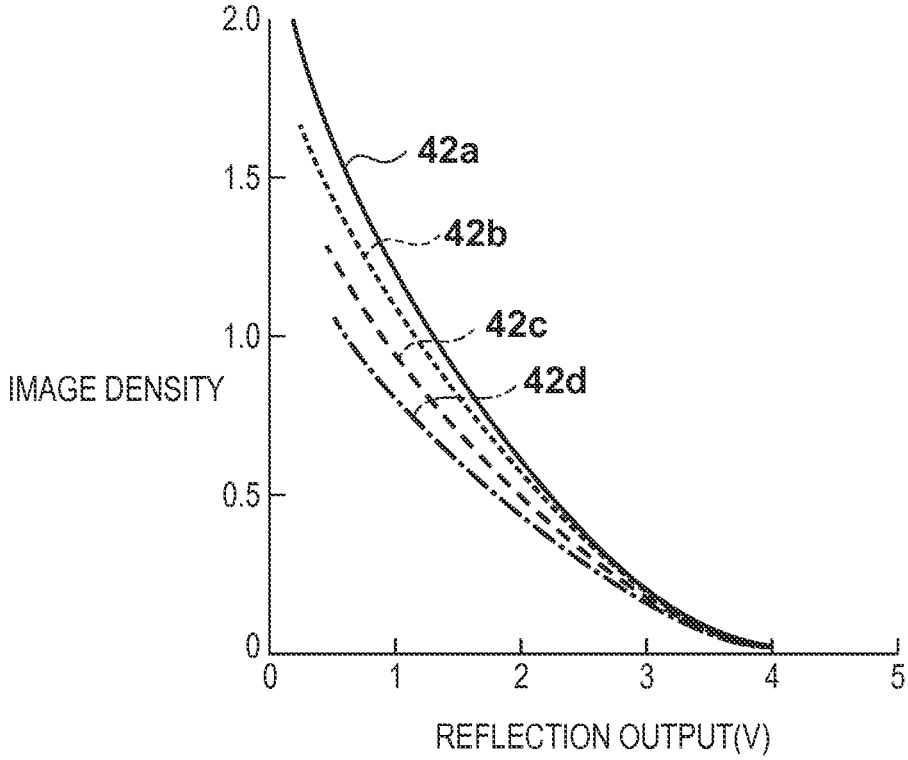
FIG. 6B is a diagram showing a relationship between reflection output and image density in the first embodiment.

FIG. 6B shows an example of the conversion tables 42*a* to 42*d* held by the luminance/density converting portion 42. The vertical axis indicates image density, and the horizontal axis indicates reflection output. As a coverage factor (image density) of a black toner area that covers the photosensitive drum 1 becomes larger, the output of the photosensor 51 gradually becomes smaller. The black toner containing carbon black absorbs light of 960 nm. Accordingly, as the amount of attached toner becomes larger, the image density becomes higher, while the reflection output becomes smaller. By selectively using the conversion tables 42*a* to 42*d* shown in FIG. 6B in accordance with the image formation condition, the CPU 28 can obtain the density signal with high accuracy. The photosensor 51 is adjusted so that the reflection output is 4 V when detecting the light reflected by the surface (base material) of the photosensitive drum 1.

Incidentally, the inventors formed measurement images of the same density using different levels of laser power, and measured the reflection outputs thereof. As a result, it was found that the reflection output tends to be higher as the laser power is lower. This is because scattering of the toner increased due to the lower laser power, and the reflection output lowered. However, the density of the toner image after being subjected to fixing processing is in proportion to the total toner amount on the recording material P. Therefore, even if the reflection output lowers, the image density does not change. Accordingly, if the conversion tables associated with different levels of laser power are separately prepared in advance, density conversion that is hardly affected by the change in the laser power can be achieved.

The reason why the maximum densities in the conversion tables 42*b* to 42*d* are lower than that in the conversion table 42*a* is because, as shown in FIG. 5A, the laser powers associated with the conversion tables 42*b* to 42*d* are originally lower than the laser power associated with the conversion table 42*a*. The absolute maximum image density is in proportion to the laser power. Note that in the case where the density of the image detected by the detecting portion 50 is significantly smaller than the set level, the CPU 28 may determine that some malfunction has occurred in the image forming apparatus 100, and display an error message on a display device (not shown) in an operation panel.

A procedure of tone characteristic control executed immediately after the image forming apparatus 100 is activated, that is, setting of the gamma-LUT 25 by the CPU 28 will be described with reference to the flowchart in FIG. 7. This flowchart is executed by the CPU 28. Note that the method for adjusting the gamma-LUT 25 is already know well, and therefore will be described simply.

In step S1, the CPU 28 measures a fixing temperature using the temperature sensor 54 for measuring the temperature of the fixing device 10. The temperature sensor 54 functions as a temperature measurement unit for measuring the fixing temperature of the fixing device 10.

In step S2, the CPU 28 determines whether or not the measured fixing temperature is equal to or lower than a prescribed temperature threshold (for example, 150° C.). The temperature threshold is a fixing temperature to be an index for determination of whether or not the tone characteristic control is necessary. If the fixing temperature is not equal to or lower than the temperature threshold, the CPU 28 skips the tone characteristic control and ends the processing according to the present flowchart. Meanwhile, if the fixing temperature is equal to or lower than the temperature threshold, the CPU 28 determines that the tone characteristic control needs to be performed, and proceeds to step S3.

In step S3, the CPU 28 waits until the components of the image forming apparatus 100 enter into a standby state. For example, upon the laser temperature of the semiconductor laser 32 reaching a prescribed temperature, the CPU 28 determines that the semiconductor laser 32 has shifted from a warm-up state to a stand-by state. Here, the CPU 28 performs potential control, which is part of image stabilization control. The CPU 28 measures the surface potential Vd of the photosensitive drum 1 using the potential sensor S0 provided to the photosensitive drum 1. The CPU 28 adjusts the grid potential Vg of the primary charging device 2 and the developing bias potential Vdc of the developing device 4 based on the measured value of the surface potential Vd, and corrects change in discharge magnitude of the primary charging device 2 and sensitivity deterioration of the photosensitive drum 1.

In step S4, the CPU 28 controls the pattern generator 29 to cause it to output image data on the measurement image of the maximum density (for example, level 255), and thereby forms the measurement image on the recording material P. Note that the contrast potential Vcont used at this time is derived from the absolute water content in the atmosphere environment. For example, the ROM 210 stores a table indicating a relationship between the absolute water content and the contrast potential Vcont, and the CPU 28 obtains, from the table, the contrast potential associated with the absolute water content measured using a sensor. Also, the CPU 28 stores the laser power value used at this time in the RAM 212. The laser power value is determined in advance by auto light power control (APC).

In step S5, the CPU 28 reads the measurement image formed on the recording material P with the CCD 21 in the reader portion.

In step S6, the CPU 28 reads the laser power value from the RAM 212, selects the conversion table associated with the value from the correspondence table shown in FIG. 5A, and sets the selected conversion table for the luminance/density converting portion 42.

In step S7, the CPU 28 converts the luminance data on the measurement image of the maximum density into the density data using the luminance/density converting portion 42. Thus, the maximum density DA at the time when the relative drum surface potential is A is obtained.

In step S8, the CPU 28 computes the contrast potential Vcont corresponding to a target largest density. Here, the specific method for determining the contrast potential Vcont will be described.

Figure 8A:
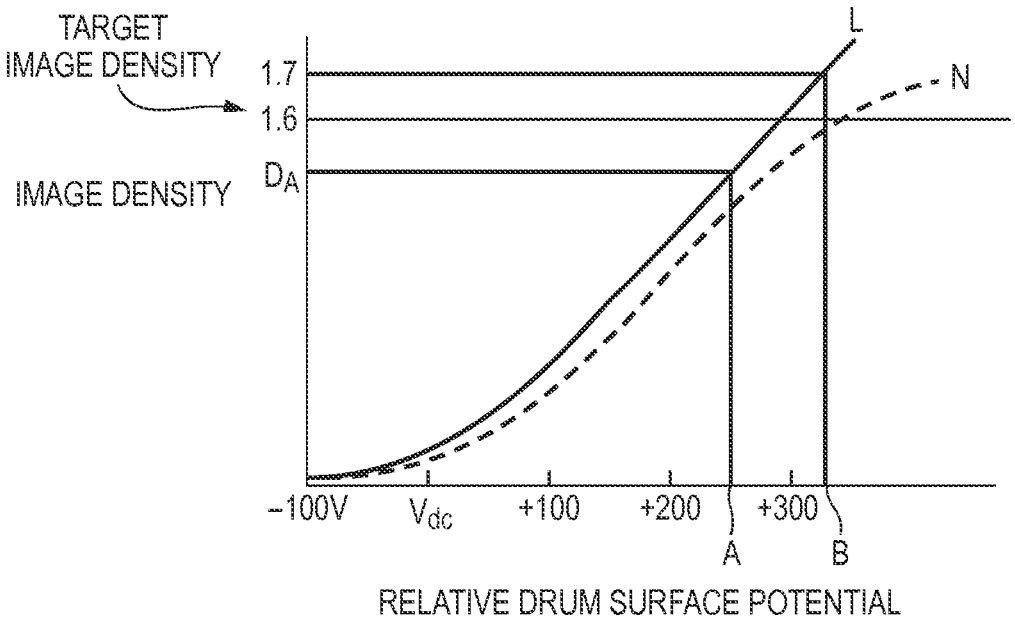
FIG. 8A is a diagram showing a relationship between relative drum surface potential and image density.

FIG. 8A shows a relationship between the relative drum surface potential and the image density. In the abovementioned step S4, the CPU 28 uniformly charges the photosensitive drum 1 with the primary charging device 2, and causes the semiconductor laser 32 to output the laser light 3 for forming the measurement image of the maximum density to form a latent image on the surface of the photosensitive drum 1. Further, the CPU 28 measures the surface potential Vd in a latent image area with the potential sensor S0. The CPU 28 obtains a difference (relative drum surface potential A) between measured values of the developing bias potential Vdc and the surface potential Vd of the photosensitive drum 1 that are currently in use. According to FIG. 8A, the maximum image density obtained with respect to the relative drum surface potential A is the abovementioned DA. The maximum image density DA is obtained in steps S5 and S6, as described above. If the conversion tables 42*a* to 42*b* are selected in accordance with the laser power, in most cases the image density corresponding to the relative drum surface potential is linear, as shown by a solid line L. Meanwhile, in a two-component development system, if the toner density in the developing device 4 decreases, in some cases the image density has a nonlinear characteristic in the vicinity of the maximum density, as shown by a broken line N. The target image density is 1.6 according to FIG. 8A, while the target image density may be set to be 1.7 in consideration of a margin of 0.1. Here, it is assumed that the target image density is 1.7. The relative drum surface potential (contrast potential B) at the time when the target image density is set to be 1.7 can be obtained using the relative drum surface potential A, the maximum density DA, and the following expression:

$$B=A\times 1.7/DA$$

Figure 8B:
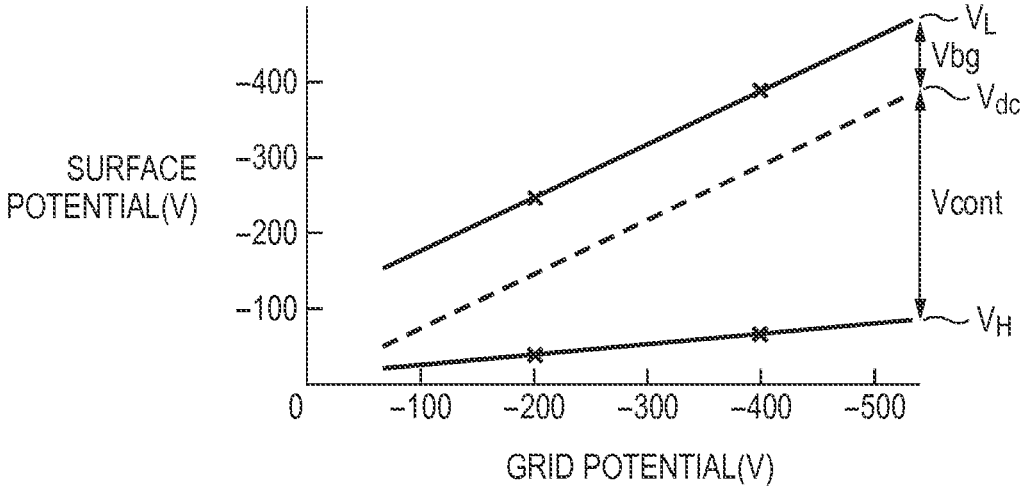
FIG. 8B is a diagram showing a relationship between grid potential and surface potential.

The method for deriving the grid potential Vg and the developing bias potential from the contrast potential based on the relationship between the grid potential Vg of the primary charging device 2 and the surface potential of the photosensitive drum 1 will be simply described. FIG. 8B shows the relationship between the grid potential Vg and the surface potential Vd of the photosensitive drum 1. The surface potential Vd at the time when the photosensitive drum 1 is scanned after the grid potential Vg is set to be −200 V and the level of the laser light 3 is set to be the minimum value in its configurable range is VL. The surface potential Vd at the time when the level of the laser light 3 to be the maximum value in the configurable range is VH. The CPU 28 measures surface potentials VL and VH using the potential sensor S0. Similarly, the CPU 28 measures the surface potentials VL and VH at the time when the grid potential Vg is set to be −400 V. The CPU 28 obtains the relationship between the grid potential Vg and the surface potential Vd shown in FIG. 8B by interpolating and extrapolating between the −200 V data and the −400 V data.

The CPU 28 sets the developing bias potential Vdc by subtracting, from VL, Vbg (for example, 100 V) that is set so that fogging toner is not attached onto the image. As shown in FIG. 8B, the contrast potential Vcont is a difference voltage between the developing bias potential Vdc and VH. Further, as shown in FIG. 8A, as the relative drum surface potential (contrast potential Vcont) is larger, the maximum density becomes higher.

The CPU 28 calculates the grid potential Vg and the developing bias potential Vdc based on the contrast potential Vcont=B computed in step S8 and the relationship shown in FIG. 8B. Note that the contrast potential Vcont=B is set to be higher by 0.1 than the usual target maximum density, namely 1.6.

Figure 3:
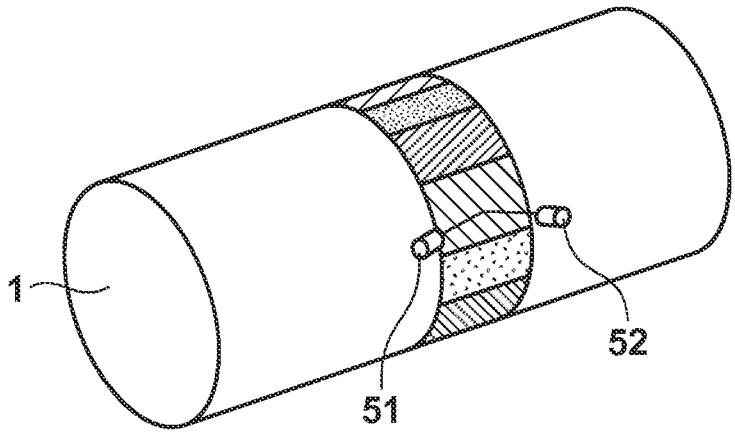
FIG. 3 is a diagram for illustrating a tone patch pattern reading operation.

In step S9, the CPU 28 causes the pattern generator 29 to output the tone pattern shown in FIG. 3. As is clear from the configuration in FIG. 2, the gamma-LUT 25 is not configured to affect the image data on the tone pattern output by the pattern generator 29. The image data on the tone pattern is output via the pulse width modulation circuit 26 to the laser driver 31, and drives the semiconductor laser 32. Thus the tone pattern serving as the toner image shown in FIG. 3 is formed on the surface of the photosensitive drum 1.

In step S10, the CPU 28 selects the conversion table associated with the laser power of the laser light 3 for forming the tone pattern. If the laser power is 128, the conversion table 42*c* is selected from the correspondence table in FIG. 5A.

In step S11, the CPU 28 detects the tone pattern on the photosensitive drum 1 with the detecting portion 50, and converts the reflection output of the photosensor 51 in the detecting portion 50 into the density data with the luminance/density converting portion 42.

In step S12, the CPU 28 specifies, from the formation position of a tone pattern at every tone level, the laser power used when the tone pattern is formed, creates the gamma-LUT 25 in association with the density data on that tone pattern, and stores the created gamma-LUT 25 in the RAM 212. The number of sets of the density data is not more than the number of the tone patterns, and therefore, in some cases the gamma-LUT 25 cannot be calculated only with the existing density data. In this case, the CPU 28 may generate the laser power in association with the density data at all levels ranging from 0 to 255 by interpolation.

After the above-described control ends, the CPU 28 displays a message "Copier: Ready" on the display device in the operation panel, and enters into a copy stand-by state. During the copy operation, the contrast potential Vdc and the gamma-LUT 25 calculated by the abovementioned method are used, and so toner images having a linear tone characteristic are formed. By regularly performing the above control, images having excellent tonality can be formed for a long time.

In the first embodiment the present invention is applied to a single-color image forming apparatus, while in the second embodiment the invention is applied to a multi-color image forming apparatus. In the multi-color image forming apparatus, the above-described conversion tables 42*a* to 42*d* are prepared as many as the colors. That is, the characteristic of the second embodiment lies in that the conversion tables associated with image formation conditions are prepared for each color.

Figure 9:
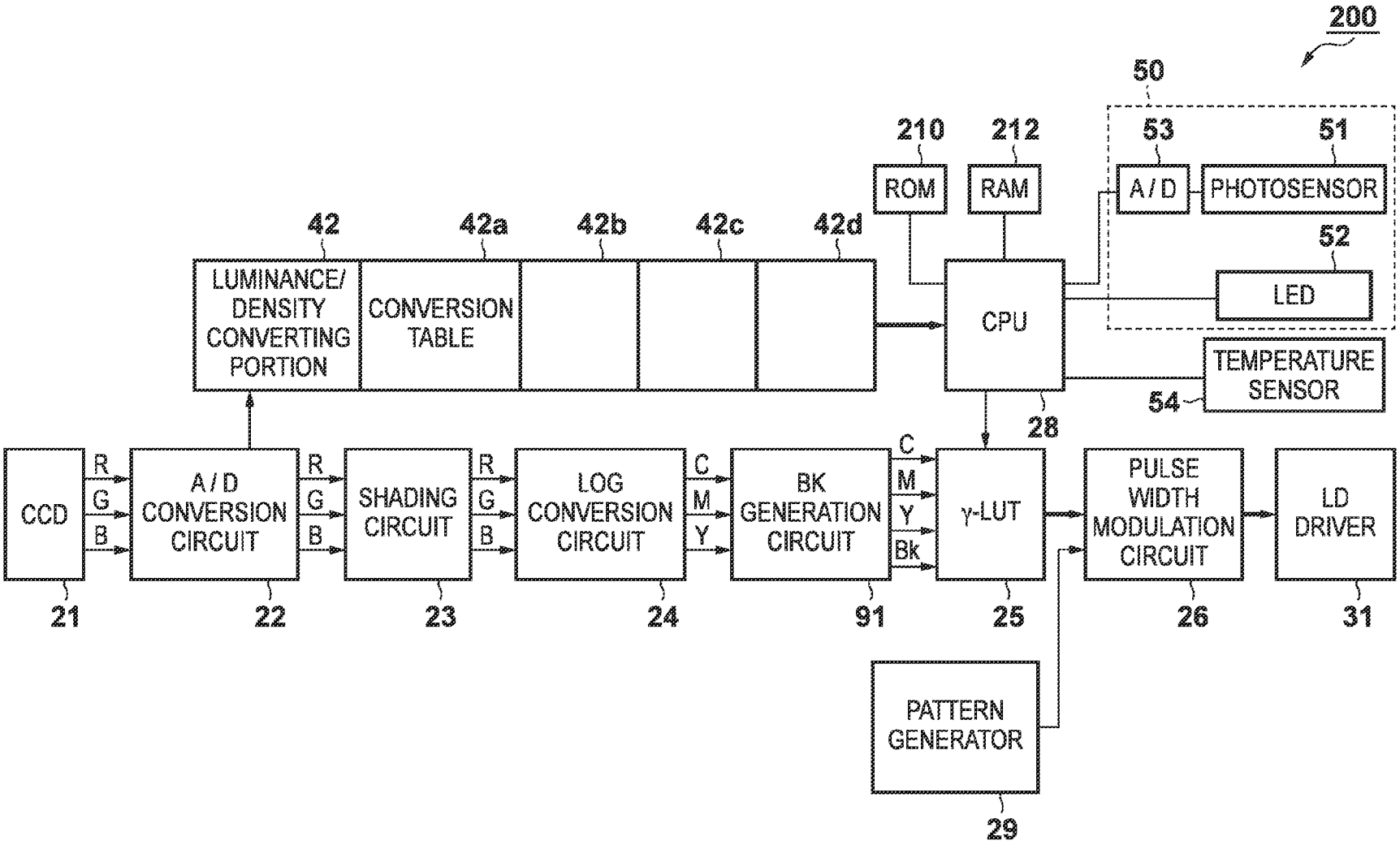
FIG. 9 is a block diagram showing the flow of an image signal in an image forming apparatus according to the second embodiment.

FIG. 9 shows a block diagram of the control portion 200 in the present embodiment. Comparing FIGS. 2 and 9, those two figures are different at least in the point that FIG. 9 additionally has a Bk generation circuit 91, and the conversion tables 42*a* to 42*d* are prepared for each color. Thus, in the second embodiment, a plurality of conversion tables are provided for each of the plurality of developers of different colors. The CPU 28 selects a conversion table for each color associated with the image formation condition set for the color from among the plurality of conversion tables.

Figure 10:
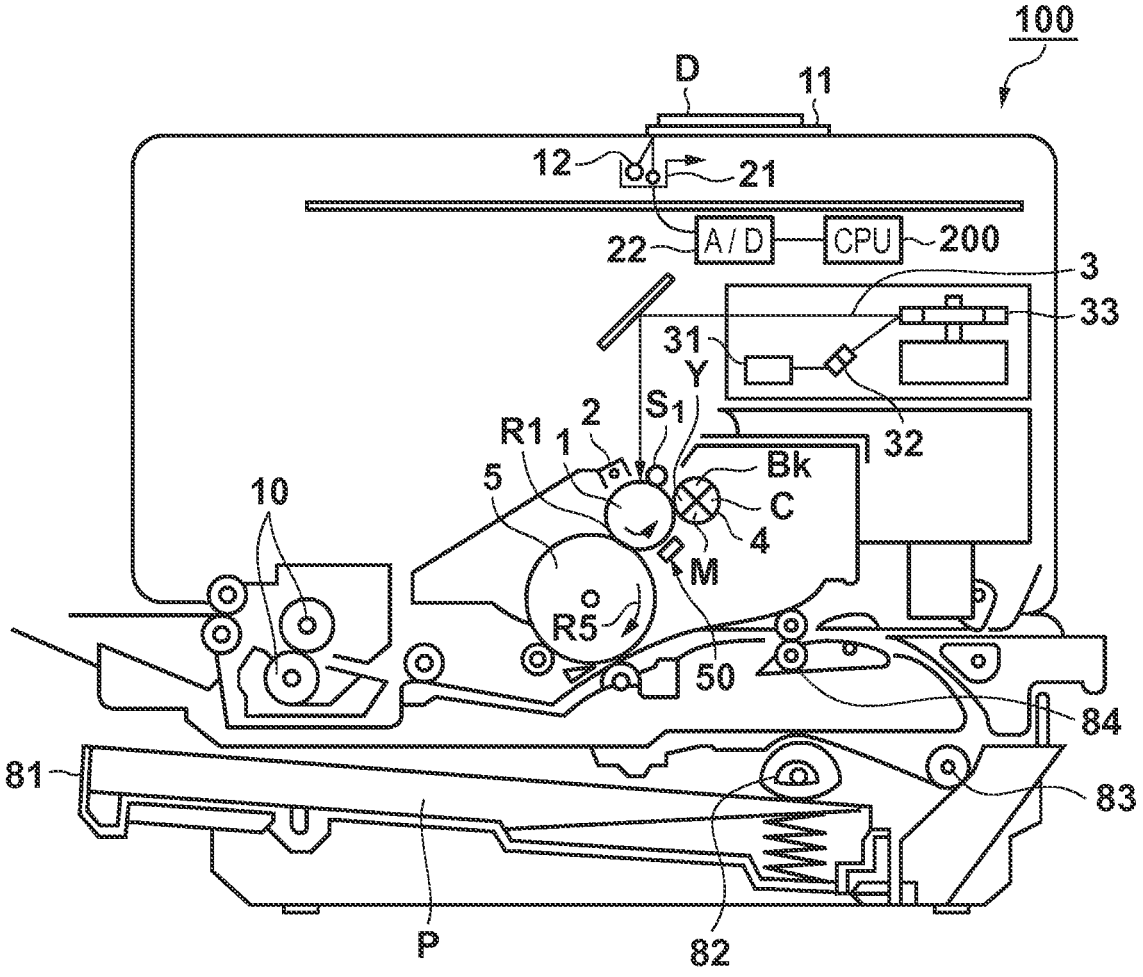
FIG. 10 is a vertical cross-sectional view showing a schematic configuration of the image forming apparatus according to the second embodiment.
Figure 11A:
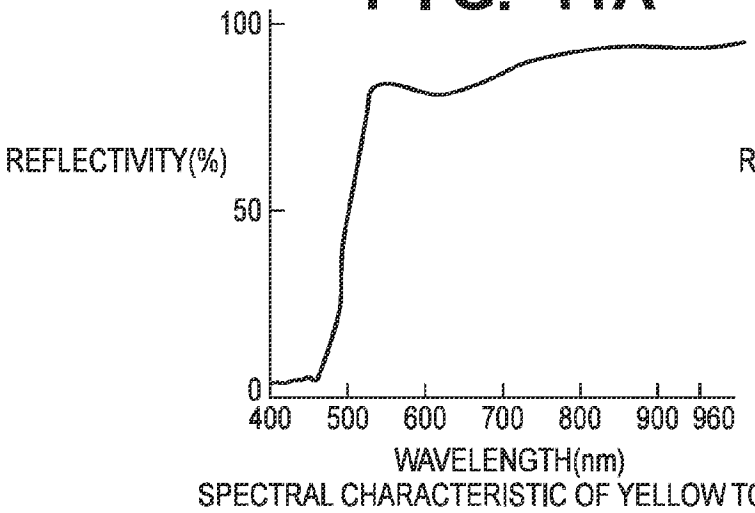
FIG. 11A is a diagram showing a spectral characteristic of yellow toner according to the second embodiment.
Figure 11B:
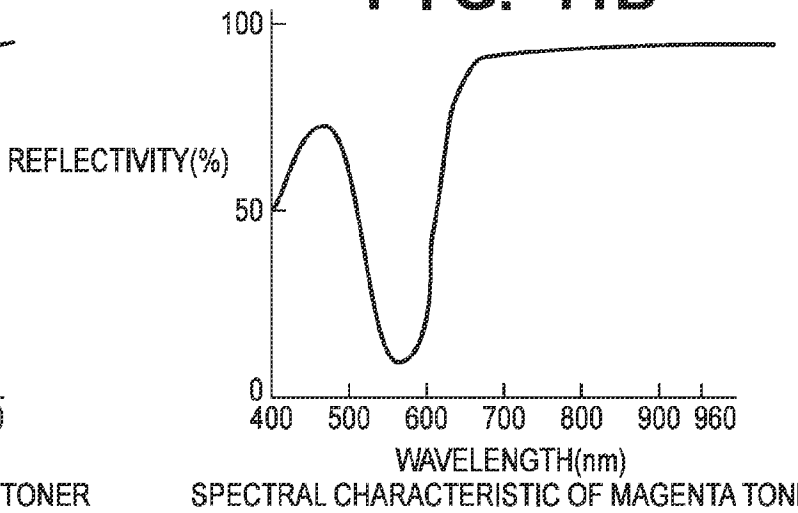
FIG. 11B is a diagram showing a spectral characteristic of magenta toner according to the second embodiment.
Figure 11C:
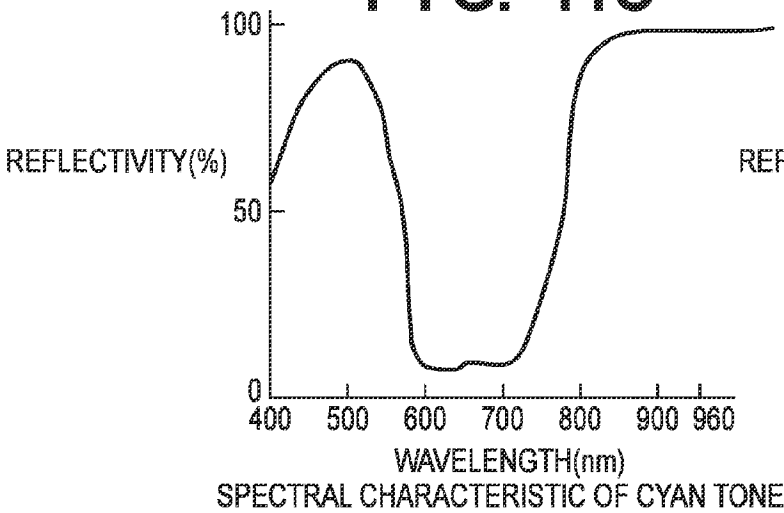
FIG. 11C is a diagram showing a spectral characteristic of cyan toner according to the second embodiment.
Figure 11D:
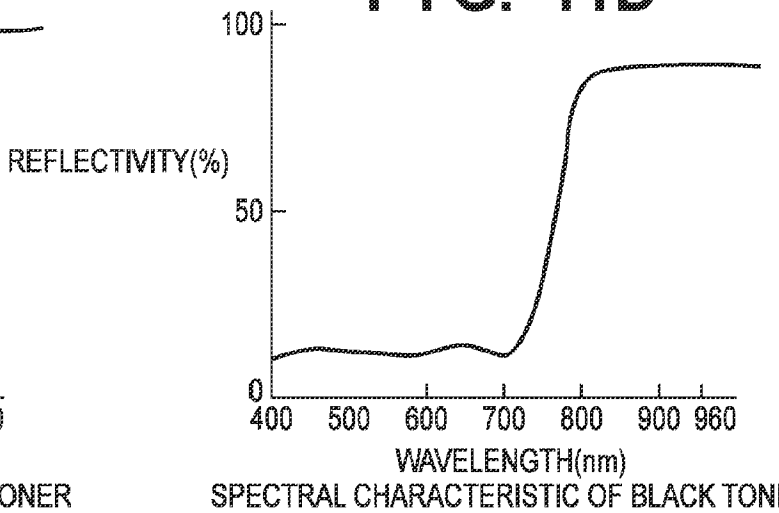
FIG. 11D is a diagram showing a spectral characteristic of black toner according to the second embodiment.

FIG. 10 shows the image forming apparatus 100 for forming a multi-color image. Note that the components already mentioned above are assigned the same reference numerals to simplify and the description thereof. The developing device 4 in the image forming apparatus 100 shown in FIG. 10 is a rotary-type developing device. The developing device 4 generates toner images of the respective colors in order by switching a developing sleeve that abuts the photosensitive drum 1. In FIG. 10, a yellow developing sleeve abuts the photosensitive drum 1. The developing device 4 may be a so-called tandem-type developing device. This is because the present invention does not depend on the type of the developing device.

The recording material P contained in a paper feed cassette 81 is supplied, via a paper feed roller 82, a transport roller 83, and a registration roller 84, to a transfer drum 5. The recording material P is wound around the transfer drum 5. Every time the transfer drum 5 rotates once, toner images of Y (yellow), M (magenta), C (cyan), and Bk (black) are transferred onto the recording material P in this order. That is, with four times of rotation of the transfer drum 5, the toner images of four colors are transferred onto the recording material P so as to be superimposed on each other. After the transfer ends, the recording material P is separated from the transfer drum 5, and the toner images are fixed by the fixing device 10.

Meanwhile, the CCD 21 in the reader portion obtains an RGB signal of a document image via a color separation filter for three colors, namely R (red), G (green), and B (blue). The A/D conversion circuit 22 converts an analog RGB luminance signal into digital luminance data, and outputs the digital luminance data to the shading circuit 23. The shading circuit 23 executes the abovementioned shading correction. The LOG conversion circuit 24 converts the RGB luminance data into CMY density data. The Bk generation circuit 91 generates black density data from the CMY density data, and creates density data on four colors, namely MCYBk. The gamma-LUT 25 executes the tone control on the density data. The density data drives the semiconductor laser 32 via the pulse width modulation circuit 26 and the laser driver 31.

Note that the developer for multi-color image formation used in the image forming apparatus 100 is toners of four colors, namely yellow, magenta, cyan, and black. The YMC toners are formed using styrene copolymer resin as a binder by dispersing color materials of yellow, magenta, and cyan, respectively. The black toner is made by mixing three colors of YMC.

Figure 12A:
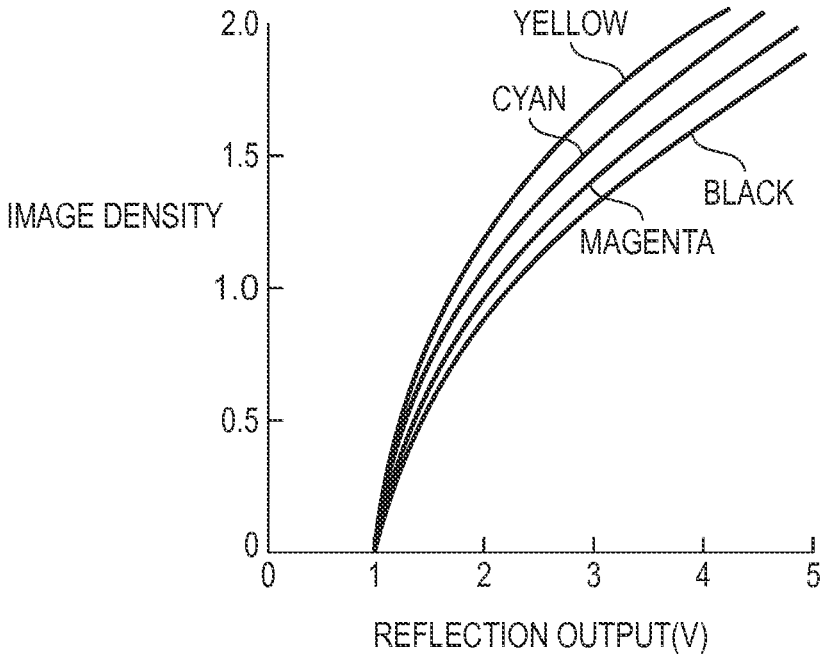
FIG. 12A is a diagram showing a relationship between reflection output and image density according to the second embodiment.

The spectral characteristics of the yellow, magenta, cyan, and black toners are shown in FIGS. 11A, 11B, 11C, and 11D, respectively. With all toners, an 80% or higher reflectivity was obtained with respect to 960 nm. Further, the image forming apparatus 100 employs, in image formation using those color toners, the two-component development system, which has advantages in terms of color purity and transparency. The photosensitive drum 1 is an OPC drum, and has a reflectivity of about 40% with respect to 960 nm. As shown in FIG. 12A, the reflection output becomes larger as more toner is applied to the photosensitive drum 1.

In the present embodiment, because of the difference in the reflectivity of the color materials of the respective colors, an independent density conversion circuit for each color that are associated with the laser power is necessary. In the present embodiment, the detecting portion 50 is set so that a drum reflection output in a state where the toner is not attached is 1 V.

Figure 12B:
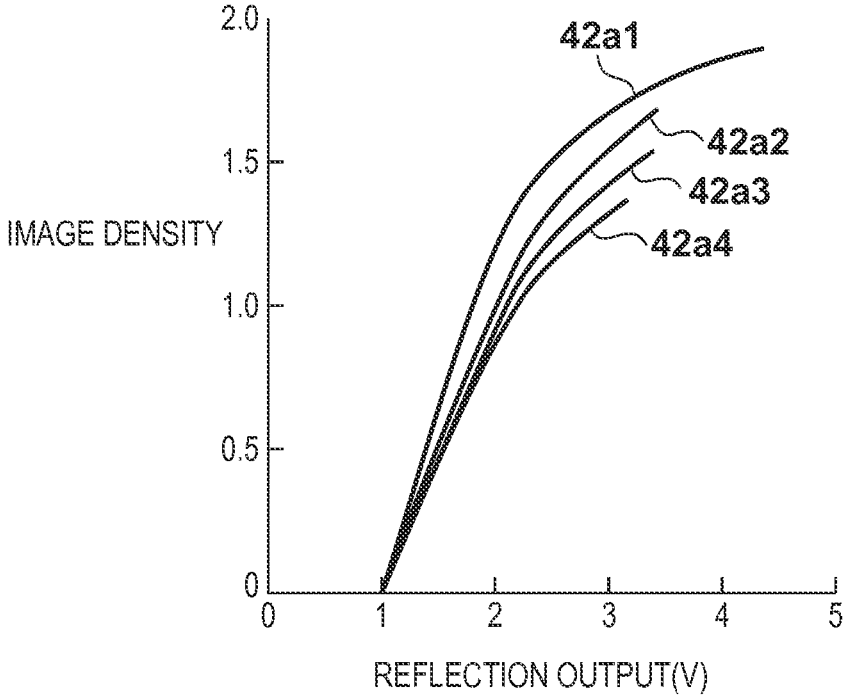
FIG. 12B is a diagram showing a relationship between reflection output and image density in accordance with laser power according to the second embodiment.

FIG. 12B shows an example of a relationship between the reflection output of the photosensor 51 for a yellow image and an actual image density. Also, FIG. 5B shows a table indicating a correspondence between the laser power and the conversion tables. In the present embodiment, as the laser power of the semiconductor laser 32 becomes lower, the reflection output of the photosensor 51 tends to becomes larger. Therefore, the CPU 28 selects the conversion table of each color associated with the laser power using the correspondence table shown in FIG. 5B.

Figure 7:
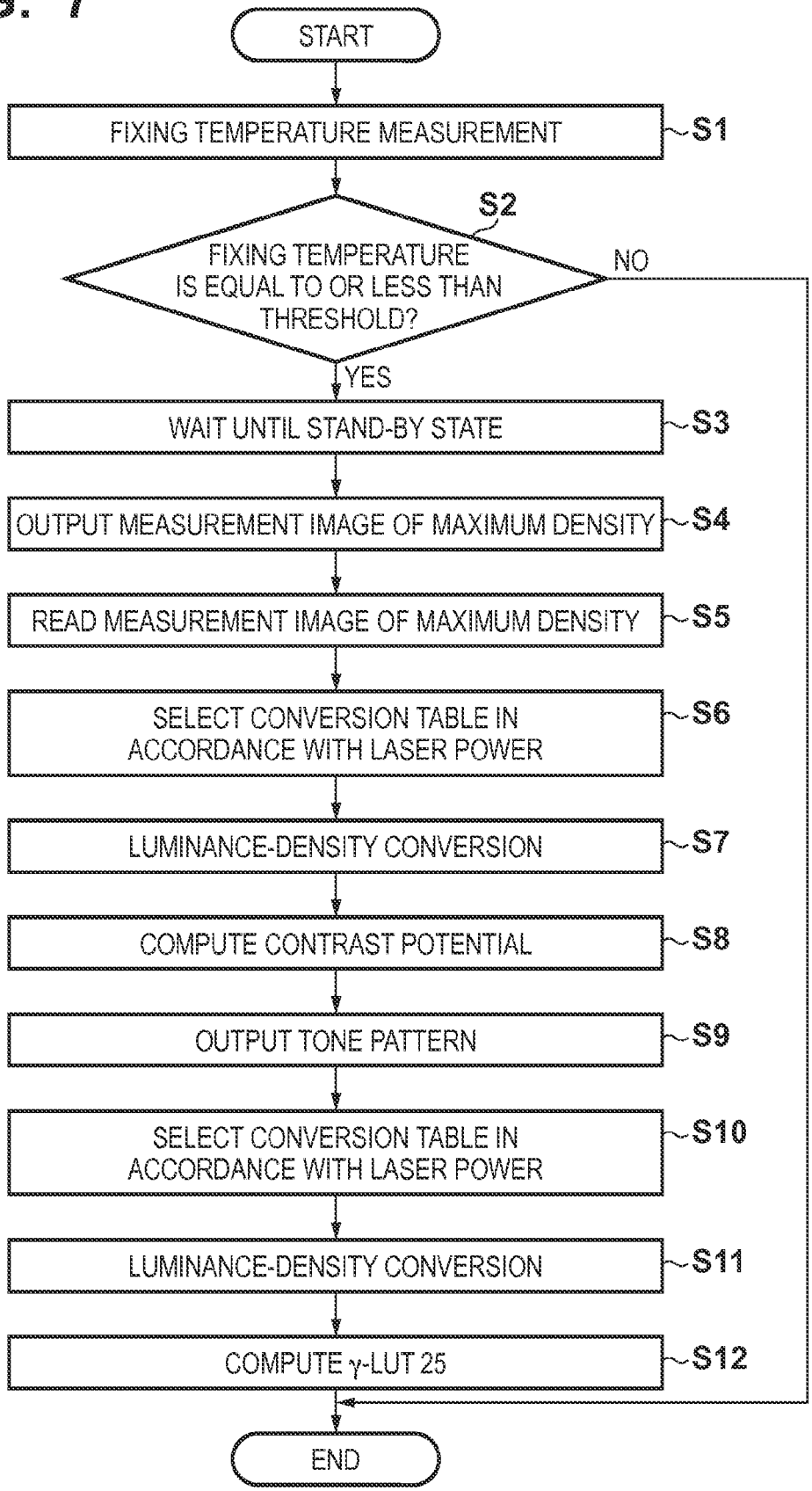
FIG. 7 is a flowchart illustrating tone correction processing in the first embodiment.

The flowchart for the second embodiment is basically the same as the flowchart shown in FIG. 7. The CPU 28 executes the steps S4 to S12 for the four colors of YMCBk individually. That is, in step S4 a measurement image of the maximum density is formed with respect to each of YMCBk, and is read in step S5. In step S6, the CPU 28 selects the conversion table for each color in accordance with the laser power. In step S7, the luminance data is converted into the density data with respect to each color. In step S8, the contrast potential and the like are determined with respect to each of YMCBk. In step S9, a tone pattern of each of YMCBk is formed and read. In step S10, the CPU 28 selects the conversion table for each color in accordance with the laser power. In step S11, the luminance data on the tone pattern of each color is converted into the density data using the selected conversion table. In step S12, the gamma-LUT 25 is created for each color.

According to the present embodiment, the same advantage as in the first embodiment is obtained by applying the present invention to the image forming apparatus 100 that forms multi-color images. That is, the image forming apparatus 100 is capable of providing high-quality multi-color images with excellent tonality and good gray balance for a long time.

In the above-described example, the photosensitive drum 1 is used as an image carrier of the image forming apparatus 100. However, the image carrier is not limited to the photosensitive drum 1, and may alternatively be a photosensitive sheet in a sheet shape or a photosensitive belt in a belt shape with a photosensitive layer on its surface, for example.

In the image forming apparatus 100 that forms multi-color tone images, if the CPU 28 changes the laser power of the semiconductor laser 32 during job execution, the CPU 28 selects the conversion table for each color in association with the changed laser power value.

Incidentally, although in the first and second embodiments the conversion table is changed in accordance with the change in the laser power, the CPU 28 may change the conversion table in accordance with the change in another type of the image formation conditions, such as the fixing temperature or the toner charge in the developer. Also in this case, a correspondence table indicating the relationship between the image formation conditions and the conversion tables are stored in the ROM 210, and is referred to by the CPU 28.

For example, as the fixing temperature becomes lower, the actual image density tends to become lower. Therefore, the CPU 28 selects or creates a conversion table with which the reflected light amount is reduced every time fixing temperature decreases. Accordingly, the CPU 28 functions as a selection unit for selecting, from among a plurality of conversion tables, a conversion table associated with the fixing temperature measured by a temperature measurement unit.

Also, the CPU 28 selects or creates a conversion table with which the reflected light amount is increased every time the toner charge decreases. The CPU 28 may predict the toner charge from the number of formed images, or estimate the toner charge from data obtained using the potential sensor S0 or the detecting portion 50. Those function as a charge measurement unit for measuring the toner charge in the developer. Thus the CPU 28 functions as a selection unit for selecting, from among a plurality of conversion tables, a conversion table associated with the toner charge in the developer measured by the charge measurement unit. The toner charge in the developer is an example of the physical parameters measured without using a measurement image.

According to the present invention, upon an image formation condition changing due to use of an image forming apparatus 100, a conversion table associated with the changed image formation condition is selected, luminance data on a measurement image is converted into density data based on the selected conversion table, and the gamma correction circuit is adjusted according to the density data. With this configuration, the gamma correction circuit can be adjusted without bothering a user when the image formation condition changes, and therefore, the image forming apparatus is capable of continuously forming high-quality images. For example, it is possible to keep a good output density range in the image forming apparatus 100, and further maintain a stable tone characteristic ranging from highlight to shadow.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-200972, filed Sep. 14, 2011, which is hereby incorporated by reference herein in its entirety.

What is claimed is:

1. An image forming apparatus comprising:

a correction unit configured to correct image data based on a correction condition;

an image bearing member;

an image forming unit configured to be controlled based on an image forming condition, and to form an image on the image bearing member based on the image data corrected by the correction unit;

a transferring unit configured to transfer the image formed on the image bearing member by the image forming unit to a recording medium;

a fixing unit configured to fix the image on the recording medium;

a measuring unit configured to measure a measurement image formed by the image forming unit;

a converting unit configured to convert, based on a converting condition, measurement data obtained by the measuring unit measuring the measurement image;

a determining unit configured to determine the converting condition based on the image forming condition used at a time when the image forming unit forms the measurement image; and a generating unit configured to generate the correction condition based on the measurement data converted by the converting unit, and wherein the measuring unit measures the measurement image before the measurement image is fixed on the recording medium.

2. The image forming apparatus according to claim 1, wherein the converting unit is configured to convert, based on the converting condition, the measurement data obtained by the measuring unit measuring the measurement image into density data.

3. The image forming apparatus according to claim 1, wherein the determining unit is configured to calculate the converting condition based on the image forming condition used at the time when the image forming unit forms the measurement image.

4. The image forming apparatus according to claim 1, wherein the correction condition is data for correcting a tone characteristic of an image to be formed by the image forming unit.

5. The image forming apparatus according to claim 1, wherein the image forming unit further comprises:

a photosensitive member;

a charging section configured to charge the photosensitive member;

an exposing section configured to expose the charged photosensitive member with a light beam to form an electrostatic latent image; and a developing section configured to form the image by developing the electrostatic latent image formed on the photosensitive member using developing material, wherein the image forming condition includes an intensity of the light beam.

6. The image forming apparatus according to claim 5, wherein the determining unit is configured to determine, if the intensity of the light beam is changed, the converting condition based on the intensity of the light beam.

7. The image forming apparatus according to claim 5, further comprising:

a storage unit configured to store converting conditions, wherein each of the converting conditions corresponds to an intensity of the light beam, and wherein the determining unit is configured to determine, from the converting conditions stored in the storage unit, a converting condition corresponding to the intensity of the light beam used at a time when the image forming unit forms the measurement image.

* * * * *